US005511988A

United States Patent [19]

Ogawa et al.

[11] Patent Number: 5,511,988

[45] Date of Patent: Apr. 30, 1996

[54] BULB SOCKET AND TERMINAL INSTALLED THEREON

[75] Inventors: Shinji Ogawa, Suzuka; Masayoshi Matsumoto, Atsugi, both of Japan

[73] Assignees: Sumitomo Wiring Systems, Ltd., Mie; Ichikoh Industries, Ltd., Tokyo, both of Japan

[21] Appl. No.: 388,486

[22] Filed: Feb. 14, 1995

Related U.S. Application Data

[62] Division of Ser. No. 206,946, Mar. 7, 1994, Pat. No. 5,411,412, which is a division of Ser. No. 896,661, Jun. 10, 1992, Pat. No. 5,320,553.

[30] Foreign Application Priority Data

| | | | |
|---|---|---|---|
| Jun. 11, 1991 | [JP] | Japan | 3-43541 |
| Jun. 11, 1991 | [JP] | Japan | 3-43542 |
| Jun. 12, 1991 | [JP] | Japan | 3-43922 |

[51] Int. Cl.[6] ..... H01R 4/48

[52] U.S. Cl. ..... 439/336; 439/482

[58] Field of Search ..... 439/332, 335, 439/336, 613, 614, 616, 617, 619, 542, 842, 843, 918

[56] References Cited

U.S. PATENT DOCUMENTS

| | | | |
|---|---|---|---|
| 2,549,134 | 4/1951 | Shaback | 439/336 |
| 3,489,891 | 1/1970 | Altissimo | 240/52.1 |
| 3,668,603 | 6/1972 | Burgen et al. | 439/336 |
| 3,805,211 | 4/1974 | Moore | 439/336 |
| 3,810,072 | 5/1974 | Moore | 439/336 |
| 4,804,343 | 2/1989 | Reedy | 439/854 |
| 4,911,658 | 3/1990 | Vielhauer | 439/544 |
| 5,154,645 | 10/1992 | Harada et al. | 439/736 |
| 5,320,553 | 6/1994 | Ogawa et al. | 439/336 |

FOREIGN PATENT DOCUMENTS

| | | |
|---|---|---|
| 1129946 | 9/1956 | France . |
| 64-29794 | 2/1989 | Japan . |
| 2165711 | 4/1986 | United Kingdom . |

*Primary Examiner*—P. Austin Bradley
*Assistant Examiner*—Hien D. Vu
*Attorney, Agent, or Firm*—Sughrue, Mion, Zinn, Macpeak & Seas

[57] ABSTRACT

A cathode terminal, to be mounted on a bulb socket, comprising a first connection strip which is elastically connected with the cathode of a mouth piece of a bulb; and a second connection strip to be connected with a connector. The cathode terminal has a covering portion formed at the leading end thereof by bending said cathode terminal so as to cover the upper end of said opening of said terminal inserting groove. Therefore, the pin of the bulb cannot be inserted into the cathode terminal inserting groove.

5 Claims, 11 Drawing Sheets

BULB SOCKET AND TERMINAL INSTALLED THEREON

This is a divisional of application Ser. No. 08/206,946 filed Mar. 7, 1994, now U.S. Pat. No. 5,416,412 which is a divisional of application Ser. No. 07/896,661 filed Jun. 10, 1992, now U.S. Pat. No. 5,320,553.

BACKGROUND OF THE INVENTION

1. Field of the Invention

The present invention relates to a bulb socket and a terminal installed on the bulb socket for use in the light of an automobile and more particularly to a cathode terminal installed on the bulb socket and electrically connected with the cathode of the bulb.

2. Description of the Related Art

In this kind of bulb socket, a metal plate is bent to form an cathode terminal 1 to be connected with a socket 2 as shown in FIGS. 20 and 21. The cathode terminal 1 is cut in the vicinity of one end thereof in the configuration of U to project a strip elastically therefrom. Thus, a connection strip 1*a* to be connected with a bulb 3 is formed. A connection strip 1*b* to be connected with a connector is formed on the other end of the terminal 1. As shown in FIGS. 22 and 23, the terminal 1 is inserted into a sectionally T-shaped groove 2*c* formed on the peripheral wall 2*b* of a bulb inserting hole 2*a* of the socket 2. The leading end of the connection strip 1*a* projecting inwardly from the inserting groove 2*c* contacts the cathode surface of a mouth piece 3*a* of the bulb 3 inserted into the bulb inserting hole 2*a*.

A cathode terminal 4 is inserted into an cathode terminal inserting groove 2*d* opposed to the anode terminal inserting groove 2*c*. A connection strip 4*a* of the anode terminal 4 is connected with the anode disposed on the bottom surface 3*d* of the bulb 3 and the other connection strip 4*b* of the anode terminal 4 is connected with the connector.

Pins 3*b* and 3*c* projecting from the peripheral surface of the mouth piece of the bulb 3 are inserted downwardly into J-shaped pin inserting grooves 2*e* and 2*f*, respectively formed on the peripheral wall 2*b* of the socket 2. Then, the bulb 3 is rotated to mount it on the socket 2.

The pin inserting grooves 2*e* and 2*f* formed on the peripheral wall 2*b* of the socket 2 are opposed to each other so that the position of each of the pin inserting grooves 2*e* and 2*f* corresponds with the position of each of the pins 3*b* and 3*c* of the bulb 3. That is, the peripheral wall 2*b* of the socket 2 has four inserting grooves formed therein, namely, the groove 2*c* for receiving the anode terminal 4 opposed to the groove 2*d* for receiving the cathode terminal 1 and the pin inserting grooves 2*e* and 2*f* opposed to each other.

The inserting grooves 2*c* and 2*d* are approximately T-shaped in sectional view as shown in FIG. 23 and open in a small width on the inner surface of the peripheral wall 2*b*. The inserting groove 2*c* has a width large enough for the connection strip 1*a* to project inwardly while the width of the inserting groove 2*d* is very small.

The pin inserting grooves 2*e* and 2*f* are sectionally U-shaped and has a width large enough for the pins 3*b* and 3*c* to be smoothly inserted thereinto. More specifically, the width of the pin inserting grooves 2*e* and 2*f* is larger than that of the opening of the inserting groove 2*d* for receiving the anode terminal and smaller than the outer diameter of the pins 3*b* and 3*c*.

Accordingly, the pin 3*b* or the pin 3*c* cannot be inserted into the inserting groove 2*d* because the width of the inserting groove 2*d* is small. However, the socket 2 is easily deformed, i.e., the width of the opening portion of the inserting groove 2*d* becomes larger because it is made of resin. As a result, the pin 3*b* or 3*c* may be inserted into the inserting groove 2*d*. As described above, the pins 3*b* and 3*c* are opposed to each other. Therefore, the other pin 3*b* or 3*c* is inserted into the inserting groove 2*c*.

As a result, the spring of the terminal is deformed, thus pressing the pin 3*b* into a portion below the connection strip 1*a* of the cathode terminal 1 and consequently, the pin 3*b* is caught by the connection strip 1*a*. Therefore, the bulb 3 cannot be taken out from the socket 2.

If the inserting grooves 2*c* and 2*d* are not opposed to each other, it is necessary that the configuration of the terminals are complicated and dimension accuracy cannot be obtained, and hence manufacturing cost is high. In addition, supposing that the pin 3*b* or the pin 3*c* of the bulb 3 is inserted into the cathode terminal inserting groove 2*c* or 2*d*, the pin 3*b* or the pin 3*c* is brought in contact with the inner surface, of the peripheral wall of the bulb inserting portion, which is not a groove-formed position but the socket 2 is deformed outwardly because the socket 2 is made of resin. As a result, the pin 3*b* or 3*c* is pressed into the inserting grooves 2*c* or 2*d*. Consequently, the bulb 3 is erroneously inserted into the socket 2.

Thus, even though the configurations of the terminals are complicated and the inserting grooves 2*c* and 2*d* are not opposed to each other, an erroneous insertion of the pin 3*b* or 3*c* into the inserting groove 2*c* or 2*d* cannot be effectively prevented.

SUMMARY OF THE INVENTION

It is an object of the present invention to provide a bulb socket and terminals to be installed on the bulb socket in which each pin of a bulb can be prevented from being inserted into each terminal-inserting groove of the bulb socket.

It is another object of the present invention to provide a bulb socket and terminals to be installed on the bulb socket in which a cathode terminal having an improved construction can be reliably held without contacting an anode terminal even though the cathode terminal is moved from a predetermined position due to vibrations. Therefore, the generation of a short circuit can be prevented.

It is still another object of the present invention to provide a bulb socket and terminals to be installed on the bulb socket in which even though a cathode terminal inclines in a terminal inserting groove, the cathode terminal becomes vertical automatically. Therefore, operation for re-inserting the cathode terminal into the terminal inserting groove can be eliminated and the cathode terminal can be prevented from being deformed or damaged.

In accomplishing this and other objects, there is provided a cathode terminal, to be mounted on a bulb socket, formed by bending a metal plate comprising a first connection strip projecting from a terminal inserting groove formed on a peripheral wall of a bulb inserting hole of the bulb socket and being elastically connected with the cathode of a mouth piece of a bulb; and a second connection strip to be connected with a connector, the cathode terminal having a locking or covering portion formed at a leading end thereof by bending the cathode terminal toward an opening of the terminal inserting groove so as to extend the locking portion to the upper end of the opening thereof formed in the bulb inserting hole so that the covering portion covers the upper end of the opening of the terminal inserting groove in installing the cathode terminal on the bulb socket by inserting the cathode terminal located at the opening thereof downwardly into the terminal inserting groove. It is preferable that a bead is formed on the covering portion formed on the leading end of the cathode terminal so as to increase the strength thereof.

According to the above construction, the covering portion is formed by bending the leading end of the cathode terminal to be installed on the socket and the opening of the terminal inserting groove of the socket is closed. Therefore, the pins of the bulb can be prevented from being inserted into the terminal inserting groove. Since the covering portion has a simple construction and can be formed by only bending the leading end of the cathode terminal, the cathode terminal can be manufactured at a low cost.

In order to achieve the objects of the present invention, there is provided a cathode terminal, to be mounted on a bulb socket, formed by bending a metal plate comprising a first connection strip, connected with the cathode of a bulb, disposed at one end thereof; a second connection strip, connected with a connector, disposed at the other end thereof; and a locking strip projecting from a base portion of the second connection strip and locked by a locking groove of the bulb socket, the cathode terminal, disposed between the first connection strip and the locking strip, having a projection extending toward the center of the bulb socket in mounting the cathode terminal on the bulb socket and positioned directly below the bottom surface of a mouth piece of the bulb in mounting the bulb on the bulb socket; the cathode terminal does not contact an anode terminal when the projection is in contact with a shoulder of the bottom surface of the mouth piece.

According to the above construction, the projection integral with the cathode terminal extends toward the center of the socket and is positioned directly below the bottom surface of the mouth piece of the bulb. Therefore, the locking strip of the cathode terminal can be prevented from being removed from the locking groove of the socket even though the automobile is vibrated. This is because the projection is brought into contact with the corner of the bottom surface of the mouth piece of the bulb. The cathode terminal does not contact the anode terminal at the locked position, thus generating no short circuit.

In order to achieve the objects of the present invention, there is provided a bulb socket comprising a bulb inserting hole disposed at an upper portion thereof; a connector inserting opening disposed at a lower portion thereof with a partitioning wall interposed between the bulb inserting hole and the connector inserting opening; a sectionally T-shaped cathode terminal inserting groove extending downwardly from the upper end of the peripheral wall of the bulb inserting hole to the partitioning wall, in which the cathode terminal is inserted into the cathode terminal inserting groove from an opening thereof disposed at the upper end thereof; a first connection strip of the cathode terminal is projected from the opening of the cathode terminal inserting groove toward the center of the bulb socket so as to connect the first connection strip with the cathode surface of the bulb; and a second connection strip is projected into the connector inserting opening through an inserting opening formed through the partitioning wall, wherein:

the bulb inserting hole comprises a larger-width portion, the width of which is a little larger than that of the first connection strip in the range from the upper end of the cathode terminal inserting groove to a position corresponding to the leading end of the first connection strip of the cathode terminal inserted into the cathode terminal inserting groove; a correcting guide means disposed below the larger-width portion and tapered from the lower end of the larger-width portion; and a smaller-width portion ranging from the lower end of the correcting guide means to the partitioning wall and having a width in such an extent that the second connection strip is capable of being inserted therethrough so that the cathode terminal diagonally inserted into the cathode terminal inserting groove becomes vertical as a result of the contact between the correcting guide means and a part of the cathode terminal. The distance between the correcting guide portion and the upper surface of the partitioning wall is set to be longer than the length of the connection strip, to be connected with the connector, of the cathode terminal so that the correcting guide portion contacts the base portion disposed at the upper portion of the connection strip before the lower end of the connection strip contacts the partitioning wall of the socket.

According to the above construction, since the guide portion is provided in the cathode terminal inserting groove, when the cathode terminal is diagonally inserted into the cathode terminal inserting groove, the base portion of the cathode terminal contacts the inclined surface of the guide portion before the lower end of the cathode terminal contacts the upper end surface of the partitioning wall. Thus, the cathode terminal is guided along the inclined surface of the guide portion and becomes vertical. Therefore, the connection strip can be accurately inserted into the inserting opening formed in the partitioning wall.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
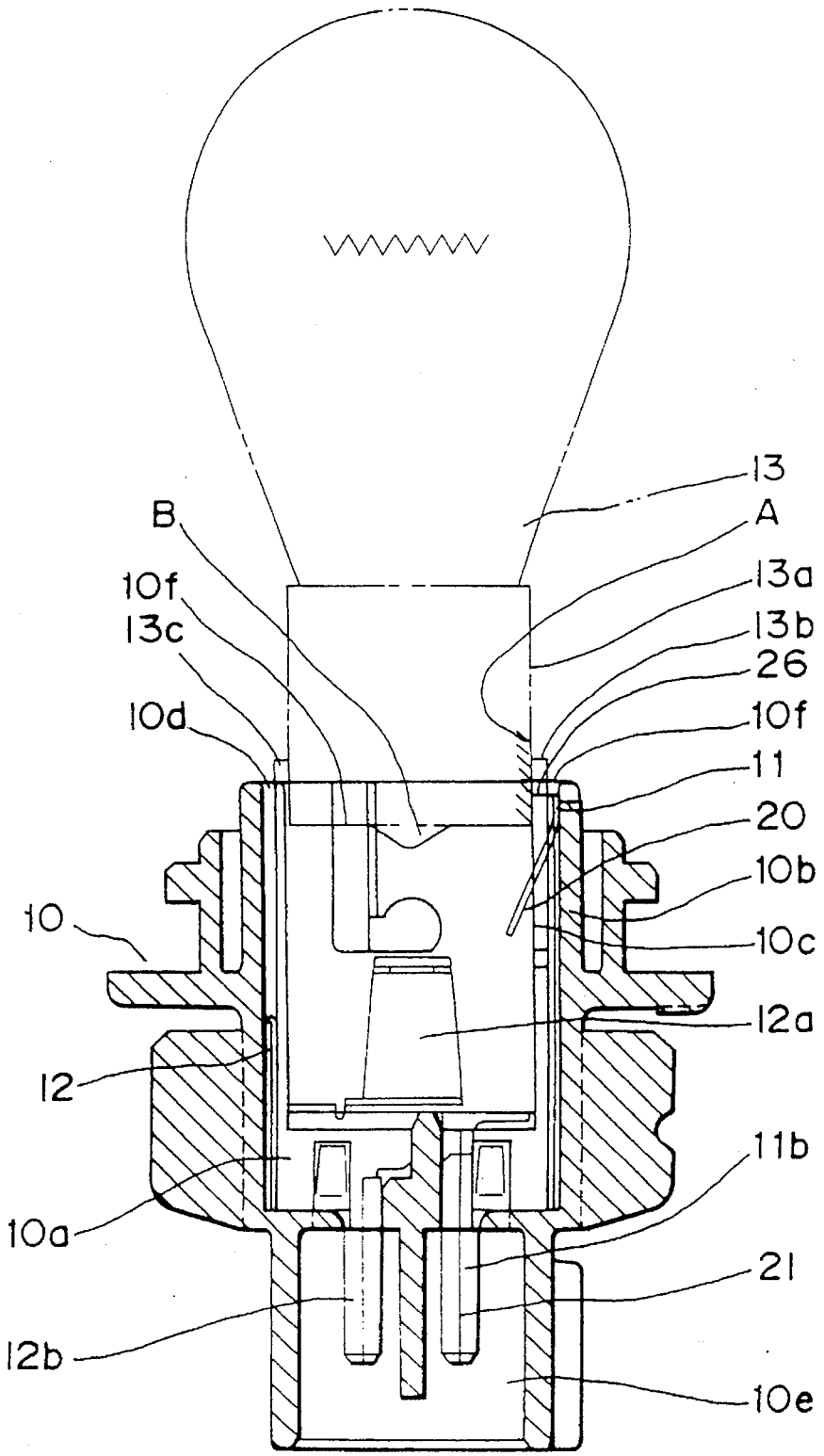
FIG. 1 is a sectional view showing a bulb socket and a cathode terminal applied thereto according to a first embodiment of the present invention.
Figure 2:
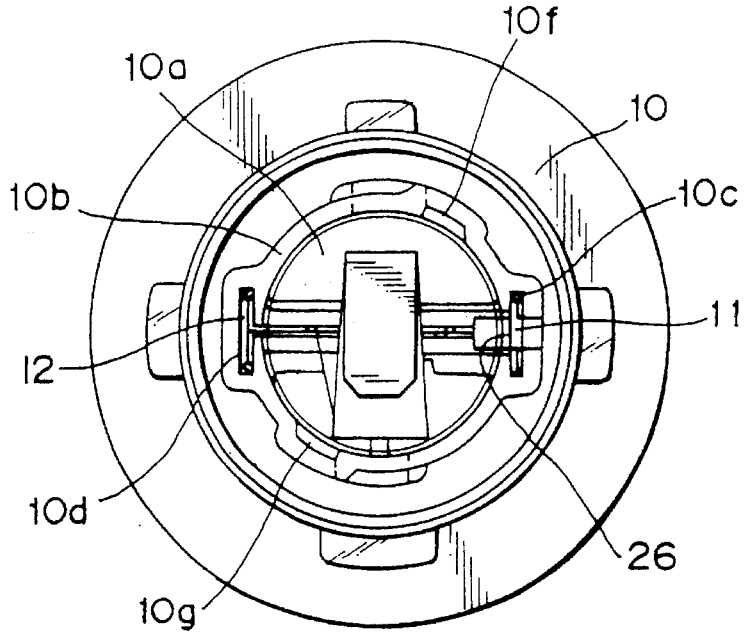
FIG. 2 is plan view showing the bulb socket in which the bulb of FIG. 1 is not mounted.

Before the description of the present invention proceeds, it is to be noted that like parts are designated by like reference numerals throughout the accompanying drawings.

A first embodiment of the present invention is described below with reference to FIGS. 1 through 6. A bulb socket 10, a cathode terminal 11, an anode terminal 12, and a bulb 13 to be installed on the socket 10 have the same construction as that of the conventional one except the construction of the cathode terminal 11. The method for installing the cathode terminal 11, the anode terminal 12, and the bulb 13 on the socket 10 is also similar to the conventional method.

Sectionally T-shaped terminal inserting grooves 10*c* and 10*d* are formed in opposition to each other on the peripheral wall 10*b* of the socket 10. The peripheral wall 10*b* surrounds a bulb inserting hole 10*a* of the socket 10 consisting of molded synthetic resin. The cathode terminal 11 and the anode terminal 12 are inserted downwardly into the terminal inserting groove 10*c* and the terminal inserting groove 10*d*, respectively. A connection strip 20 integral with the cathode terminal 11 is connected with the cathode (A) of a mouth piece 13*a* of the bulb 13 to be inserted into the bulb inserting hole 10*a*. The other connection strip 21 integral with the cathode terminal 11 is connected with a connector (not shown) to be inserted into a connector inserting opening 10*e* of the socket 10. Similarly, a connection strip 12*a* of the anode terminal 12 is connected with the anode (B) of the bulb 13 and the other connection strip 12*b* thereof is connected with the connector.

The cathode terminal 11 and the anode terminal 12 are inserted into the terminal inserting groove 10*c* of the socket 10 and the terminal inserting groove 10*d* thereof, respectively and then, the bulb 13 is installed on the socket 10.

That is, J-shaped pin inserting grooves 10*f* and 10*g* are formed in opposition to each other on the peripheral wall 10*b* of the socket 10 with a certain distance spaced from the terminal inserting grooves 10*c* and 10*d*, respectively. Pins 13*b* and 13*c* projecting in opposition to each other from the peripheral surface of the mouth piece 13*a* are inserted into the pin inserting grooves 10*f* and 10*g*, respectively. When the pins 13*b* and 13*c* reach the lower end of the pin inserting grooves 10*f* and 10*g*, respectively, the bulb 13 is rotated, and the pins 13*b* and 13*c* are fixed thereto. As a result, the bulb 13 is fixed to the socket 10.

Figure 3:
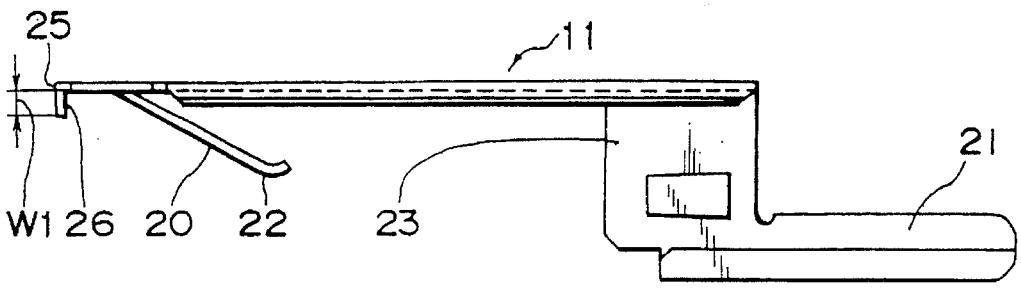
FIG. 3 is front view showing the cathode terminal to be applied to the bulb socket of FIG. 1.
Figure 4:
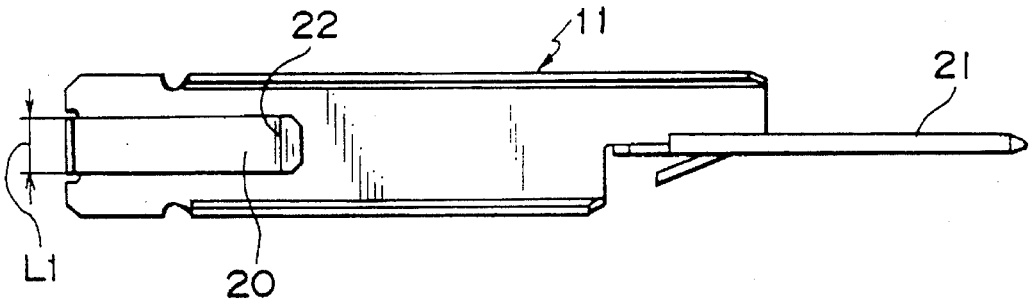
FIG. 4 is plan view of the cathode terminal of FIG. 3.
Figure 5:
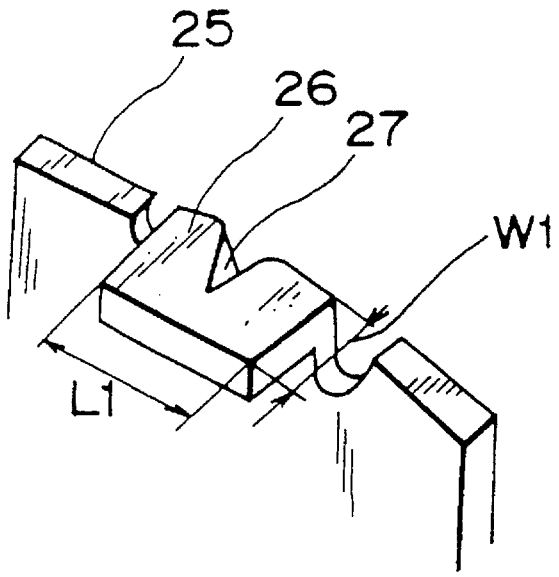
FIG. 5 is a partially enlarged perspective view showing the cathode terminal of FIG. 3.

A metal strip in the configuration of a narrow band is bent as shown in FIGS. 3 and 4 to form the connection strip 20 to be connected with the cathode of the bulb 13 and the connection strip 21 to be connected with the connector.

Figure 6:
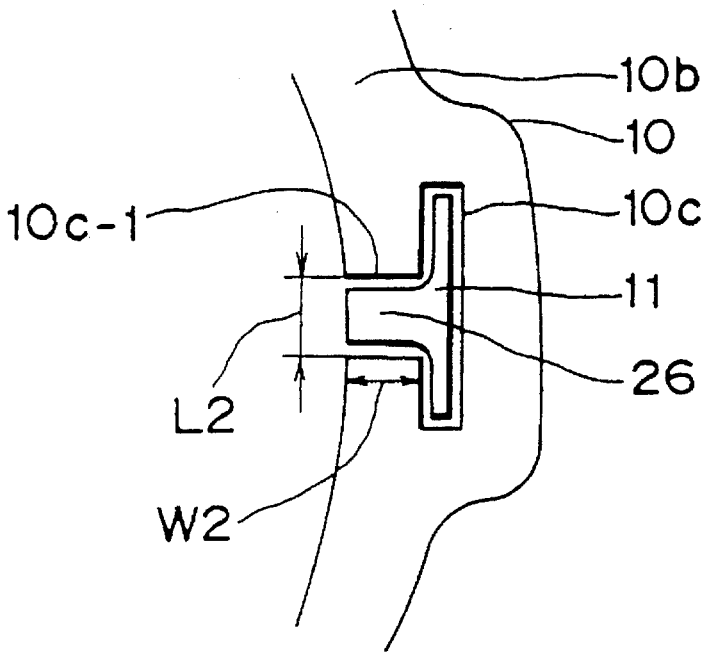
FIG. 6 is a partially enlarged plan view showing the state in which the cathode terminal is mounted on a terminal inserting groove.

The center portion of the leading end 25 of the cathode terminal 11 positioned at the upper end of the opening of the terminal inserting groove 10*c* is bent to form covering means in the form of a covering portion 26. The covering portion 26 is bent in the direction which is the same as the direction in which the connection strip 20 is bent. As shown in FIG. 6, the length L1 of the covering portion 26 is a little smaller than the dimension L2 of a narrow-width portion 10*c*-1 of the opening of the terminal inserting groove 10*c*, and the width W1 of the covering portion 26 is approximately equal to the width W2 of the narrow-width portion 10*c*-1. Accordingly, the opening of the terminal inserting groove 10*c* is covered with the covering portion 26 when the cathode terminal 11 is installed on the socket 10.

It is preferable that a bead portion 27 is formed on the covering portion 26 of the cathode terminal 11 so as to improve the strength thereof.

Since the covering portion 26 is formed on the leading end of the cathode terminal 11, the covering portion 26 covers the opening of the terminal inserting groove 10*c* when the cathode terminal 11 is inserted into the terminal inserting groove 10*c* as shown in FIG. 1. Therefore, if the pin 13*b* is to be erroneously inserted into the terminal inserting groove 10*c* in inserting the bulb 13 into the bulb inserting hole 10*a*, the pin 13*b* is brought in contact with the covering portion 26. Thus, the pin 13*b* cannot be inserted into the terminal inserting groove 10*c*.

A smoothly curved portion 22 is formed in the vicinity of leading end of the connection strip 20 of the cathode terminal 11 so that the curved portion 22 serves as the contact point between the connection strip 20 and the cathode of the mouth piece 13*a* of the bulb 13. Thus, a metal plated on the mouth piece 13*a* can be prevented from being separated therefrom. In addition, a projection 23 disposed, inwardly of the connection strip 20 projects from the cathode terminal 11 toward the center of the socket 10 so that the projection 23 is locked by the bottom surface of the bulb 13. Thus, the bulb 13 prevents the cathode terminal 11 from being moved or removed from the terminal inserting groove 10*c* so that the cathode terminal 11 does not contact the anode terminal 12. Thus, the generation of a short circuit can be prevented.

As apparent from the foregoing description, according to the first embodiment, the covering portion is formed by bending the leading end of the cathode terminal to be installed on the socket and the opening of the terminal inserting groove of the socket is closed. Therefore, the pins of the bulb can be prevented from being inserted into the terminal inserting groove. Since the covering portion has a simple construction and can be formed by only bending the leading end of the cathode terminal, the cathode terminal can be manufactured at a low cost.

A second embodiment of the present invention is described below with reference to FIGS. 7 through 15. A bulb socket 30, a cathode terminal 31, an anode terminal 32, and a bulb 33 to be installed on the socket 30 have the same construction as that of the conventional one except the construction of the cathode terminal 31. The method for installing the cathode terminal 31, the anode terminal 32, and the bulb 33 on the socket 30 is also similar to the conventional method.

Terminal inserting grooves 30*c* and 30*d* are formed on the peripheral wall 30*b* of the socket 30. The peripheral wall 30*b* surrounds a bulb inserting hole 30*a* of the socket 30 consisting of molded synthetic resin. The cathode terminal 31 and the anode terminal 32 are inserted downwardly into the terminal inserting groove 30*c* and the terminal inserting groove 30*d*, respectively. Locking strips 40 and 50 integral with the cathode terminal 31 and the anode terminal 32, respectively, are locked by locking grooves 30*e* and 30*f*, respectively formed on the socket 30. In this manner, the cathode terminal 31 and the anode terminal 32 are installed on the socket 30 at a predetermined position thereof.

At the installed position of the cathode terminal 31 and the anode terminal 32, a connection strip 41 disposed on one end of the cathode terminal 31 is connected with the cathode (A) of the mouth piece 33*a* of the bulb 33 to be inserted into the bulb inserting hole 30*a*, and a connection strip 42 disposed on the other end of the cathode terminal 31 is connected with a connector (not shown) to be inserted into a connector inserting opening 30*g* of the socket 30.

Figure 9:
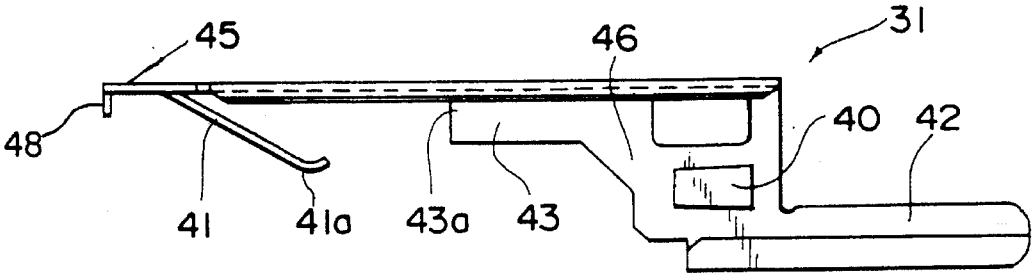
FIG. 9 is a front view showing the cathode terminal shown in FIG. 7.
Figure 10:
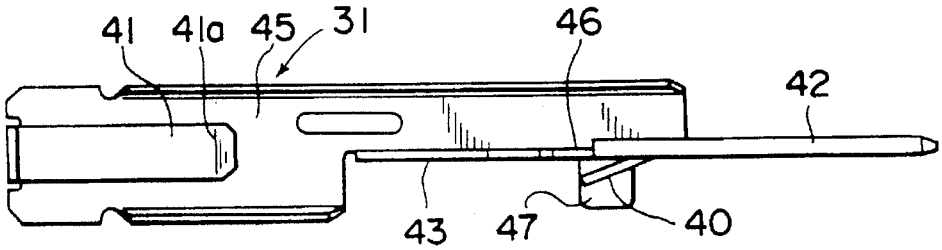
FIG. 10 is plan view of the cathode terminal of FIG. 9.
Figure 11:
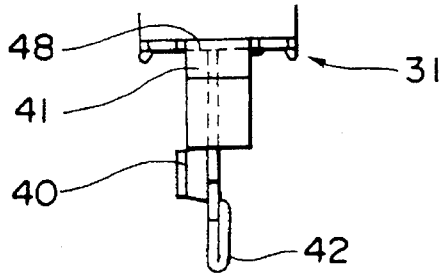
FIG. 11 is a left side elevation of FIG. 10.

A narrow-band metal strip is bent and partially cut to form the cathode terminal 31 in the configuration as shown in FIGS. 9 through 11. That is, a strip integral with a narrow-band base plate 45 (shown in FIGS. 9 through 11) elastically projects therefrom in the vicinity of one end (left end of base plate 45) thereof along the center line in the widthwise direction thereof to form the connection strip 41. The leading end of the connection strip 41 projects toward the center of the socket 30 in mounting the cathode terminal 31 on one socket 30 and is curved to form a smoothly curved contact 41*a*.

Figure 7:
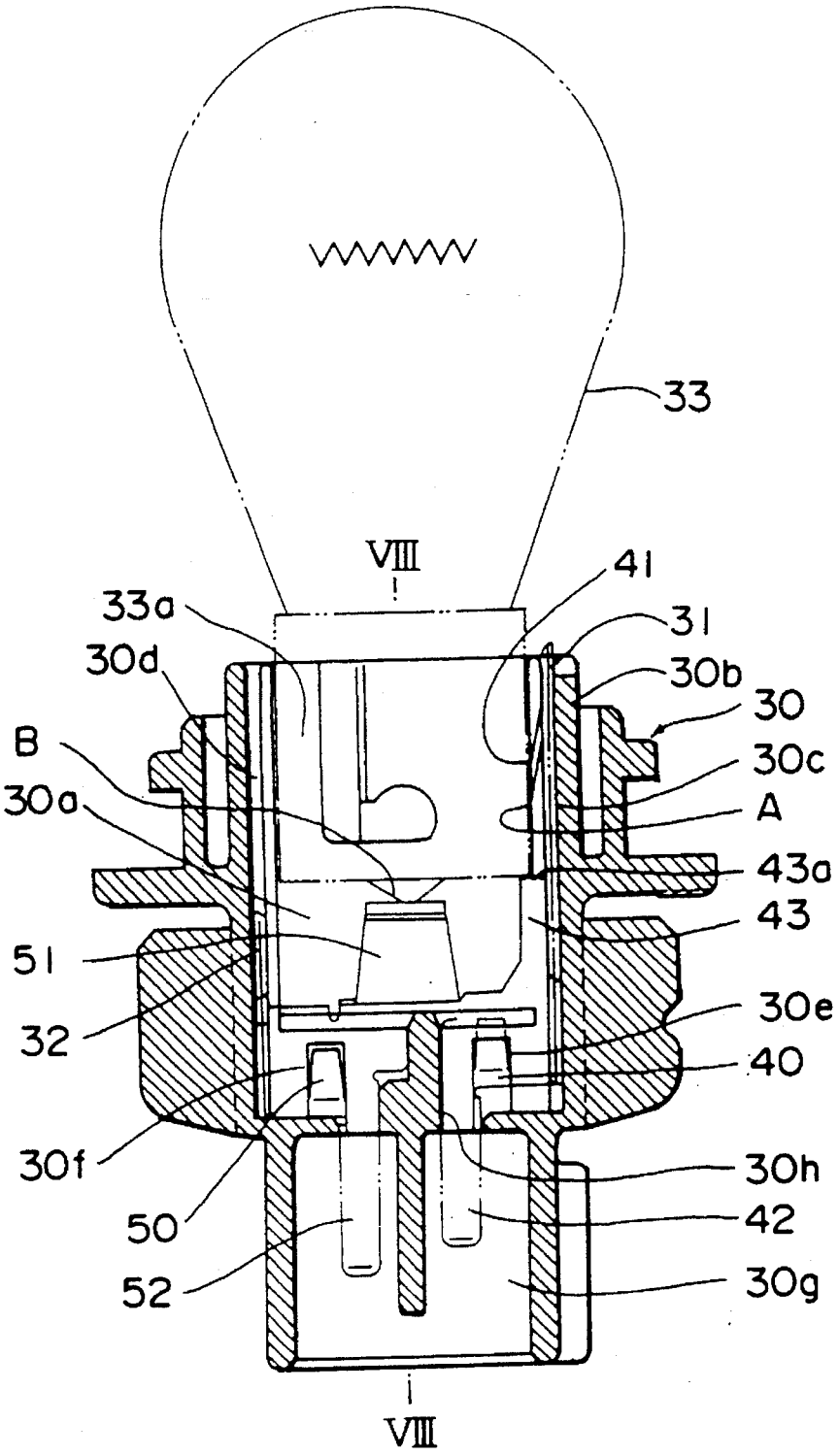
FIG. 7 is a sectional view showing a bulb socket and a cathode terminal applied thereto according to a second embodiment of the present invention.

A projection 43 is formed by bending and projecting a part of the base plate 45 at a right angle therewith from approximately the center thereof. The width of the projection 43 is approximately the half of the width of the base plate 45. Similarly to the connection strip 41, when the cathode terminal 31 is mounted on the socket 30, the projection 43 faces toward the center of the socket 30 and the surface of the leading end of the projection 43 serves as a locking surface 43*a* for being locked by engagement with the bulb 33 as will be described later. The locking surface 43*a* projects horizontally directly below the socket 30 when the cathode terminal 31 is mounted on the socket 30 as shown in FIG. 7.

The projection 43 extends toward the other end of the base plate 45 and projects in the direction in which the base plate 45 is bent to form the projection 43. Thus, a base portion 46 of a connection strip 42 to be connected with the connector is formed.

In addition to the locking strip 40, a projection 47 extending in the peripheral direction of the socket 30 is formed in parallel with the locking strip 40 on the base portion 46 so that the width of the base portion 46 of the connection strip 42 is equal to or slightly smaller than the width of the upper end of the opening of the cathode terminal inserting groove 30*c*. The projection 47 and the base plate 45 are disposed in the same plane.

The leading end of the base plate 45 is bent to form a locking portion 48 on the cathode terminal 31 so that when the cathode terminal 31 is inserted into the terminal inserting groove 30*c* of the socket 30, the opening of the terminal inserting groove 30*c* is covered with the locking portion 48. Thus, the pin of the bulb 33 cannot be erroneously inserted into the opening of the terminal inserting groove 30*c*.

The locking strip 40 of the cathode terminal 31 is locked by the locking groove 30*e* formed alongside the opening 30*h* for receiving the connection strip 42 to be connected with the connector when the cathode terminal 31 is mounted on the socket 30. In this condition, the connection strip 41 contacts the cathode surface of the mouth piece 33*a* of the bulb 33 and the locking surface 43*a* of the projection 43 positioned below the connection strip 41 is disposed below the bottom surface of the mouth piece 33*a* of the bulb 33. In this condition, the anode terminal 32 does not contact the cathode terminal 31 and thus a short circuit is not generated.

Figure 8:
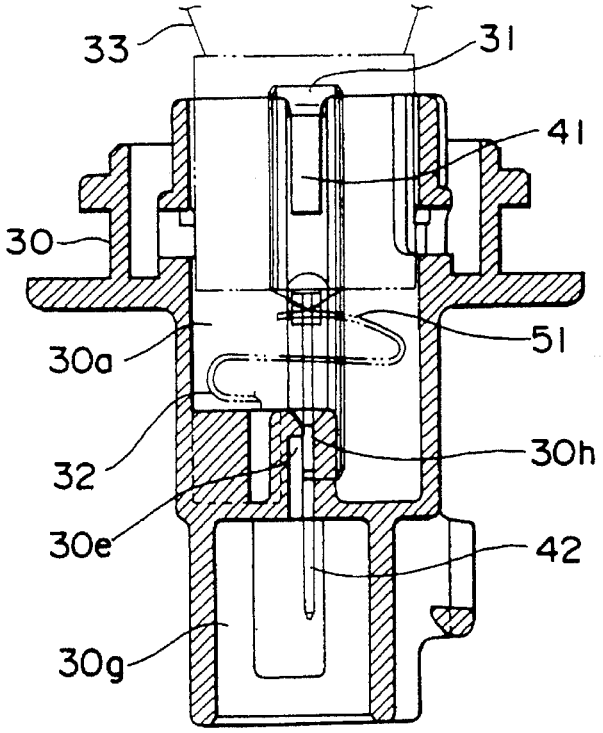
FIG. 8 is a sectional view of the bulb socket taken along the line II—II of FIG. 7.

When the cathode terminal 31 is disengaged from the locking strip 40 as a result of vibrations imparted to the automobile as shown in FIGS. 7 and 8, the projection 43 disposed directly below the bottom surface of the mouth piece 33*a* moves upwardly, and as a result, the locking surface 43*a* thereof contacts the shoulder of the bottom surface of the mouth piece 33*a*. Thus, the cathode terminal 31 is held in this condition. The base portion 46 of the cathode terminal 31 does not contact the lower surface of the connection portion 51 of the anode terminal 32 at the cathode terminal-held position. Therefore, the cathode terminal 31 does not contact the anode terminal 32 and thus the generation of a short circuit can be prevented.

The projection 47 is provided in a lower portion of the cathode terminal 31, namely, on the base portion 46 of the connection strip 42. Thus, the cathode terminal 31 has a large width in the vicinity where the projection is formed. Since the cathode terminal 31 is inserted into the terminal inserting groove 30*c* of the socket 30 from the large-width portion thereof, the cathode terminal 40 is inserted thereinto at a right angle with the upper end of the opening of the inserting groove 30*c*.

Figure 12:
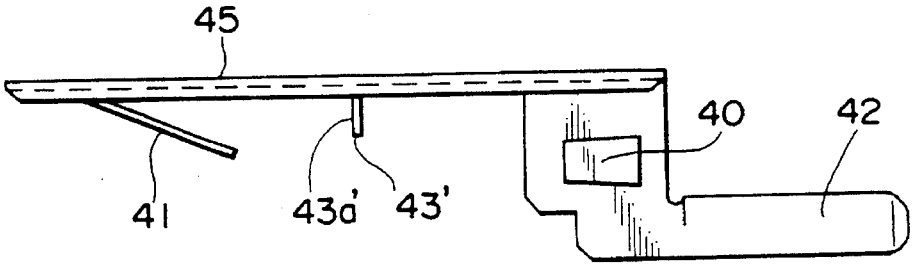
FIG. 12 is a front view showing a cathode terminal according to a modification of the second embodiment.
Figure 13:
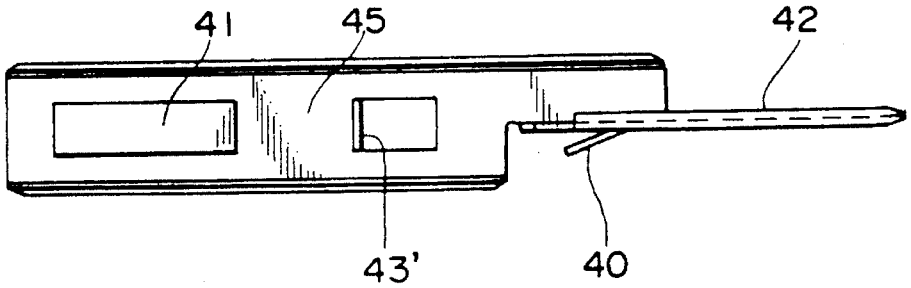
FIG. 13 is a plan view of the cathode terminal of FIG. 12.
Figure 14:
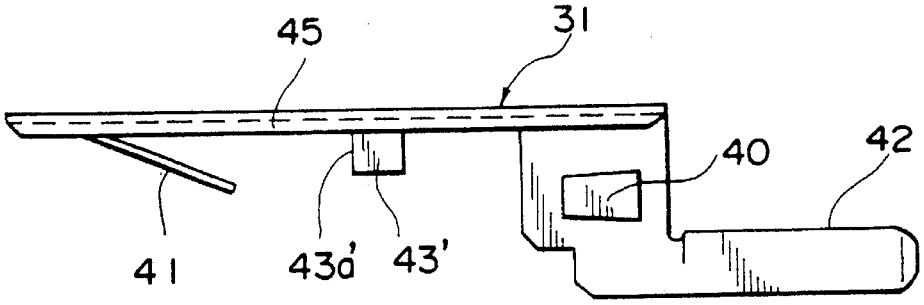
FIG. 14 is a front view showing a cathode terminal according to another modification of the second embodiment.
Figure 15:
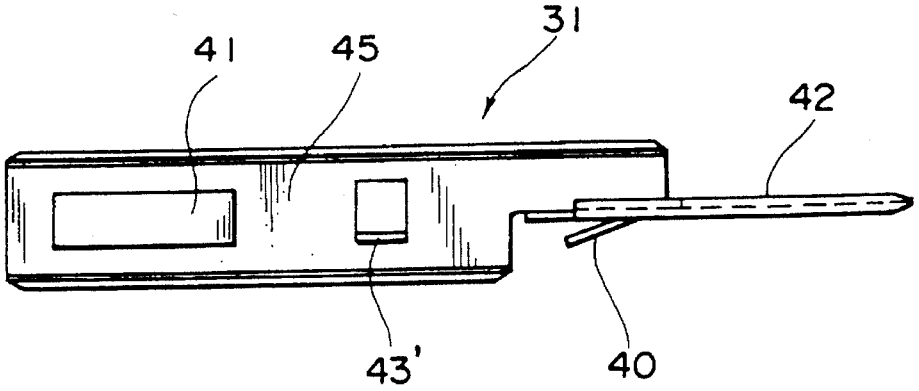
FIG. 15 is a plan view of the cathode terminal of FIG. 14.

The projection 43 is formed on the cathode terminal 31 for the locking surface 43*a* to prevent the cathode terminal 31 from being removed from the socket 30 owing to the contact between the locking surface 43*a* and the bottom surface of the mouth piece 33*a* of the bulb 33. Thus, the projection 43 may be formed as shown in FIGS. 12 and 13 (first modification of second embodiment) or FIGS. 14 and 15 (second modification of second embodiment).

According to the first and second modifications as shown in FIGS. 12, 13, 14, and 15, a projection 43' is formed by projecting a strip from the center portion in the widthwise direction of the base plate 45 at a position corresponding to that of the locking surface 43*a* of the second embodiment. The projection 43' is at a right angle with the base plate 45 and projects toward the center of the socket 30 when the cathode terminal 31 is mounted on the socket 30. The upper surface 43*a'* of the projection 43' serves as the locking surface which contacts the bottom surface of the mouth piece 33*a* of the bulb 33.

The projection directions of the projection 43' of the first modification is different from that of the projection 43' of the second modification, but both projections 43' project toward the center of the socket 30 and below the bottom surface of the mouth piece 33*a* of the bulb 33 in parallel therewith.

Other portions of the first and second modification are similar to those of the second embodiment and thus have the same reference numeral. Therefore, the description thereof is omitted herein.

As apparent from the above description, according to the second embodiment, the projection integral with the cathode terminal extends toward the center of the socket and is positioned directly below the bottom surface of the mouth piece of the bulb. Therefore, the locking strip of the cathode terminal can be prevented from being removed from the locking groove of the socket even though the automobile is vibrated. This is because the projection is brought into contact with the shoulder of the bottom surface of the mouth piece of the bulb. The cathode terminal does not contact the anode terminal at the locked position, thus generating no short circuit.

The projection is formed by bending the cathode terminal or cutting a part thereof so as to form the projection. Therefore, it is unnecessary to provide a member for holding the cathode terminal in the socket. Thus, the cathode terminal can be manufactured at a low cost.

A third embodiment of the present invention will be described below with reference to FIGS. 16 through 19.

According to a bulb socket of the third embodiment, a bulb inserting hole 61*a* is formed in an upper portion of a socket 61 and a connector inserting opening 61*b* is formed in a lower portion thereof with a partitioning wall 61*c* interposing between the openings 61*a* and 61*b*. A sectionally T-shaped cathode terminal inserting groove 70 and a sectionally T-shaped anode terminal inserting groove (not shown) are formed in opposition to each other on a peripheral wall 61*d* of the bulb inserting hole 61*a*. A cathode terminal 62 and an anode terminal (not shown) formed by bending a metal plate are inserted into the cathode terminal inserting groove 70 and the anode terminal inserting groove, respectively. A connection strip 62*a* of the cathode terminal 62 contacts the cathode surface (A) of the bulb 64 to be inserted into the bulb inserting hole 61*a*, and a connection strip of the anode terminal contacts the anode surface (B) of the bulb 64. A connection strip 62*b* of the cathode terminal 62 and a connection strip of the anode terminal are connected with a connector (not shown) to be inserted into the connector inserting opening 61*b*. The cathode terminal 62 is composed of a narrow-band metal plate. That is, the central portion in the vicinity of the upper end of a base portion 62*c* is partly cut to form a strip elastically projected in the longitudinal direction of the base portion 62*c*. Thus, the connection strip 62*a* to be connected with the bulb 64 is formed. A half-width portion of the base portion 62*c* disposed below the connection strip 62*a* is bent at a right angle with the metal plate to form the base portion 62*d* of the connection strip 62*b* which projects downward from the lower end of the base portion 62*d*.

Figure 16:
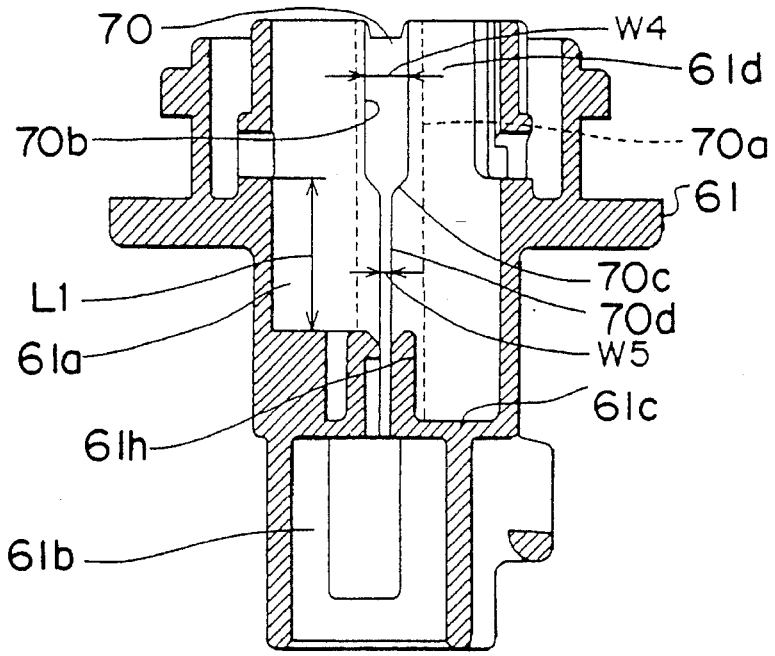
FIG. 16 is a sectional view showing a bulb socket to which a cathode terminal is applied according to a third embodiment of the present invention.

As shown in FIG. 16, a cathode terminal inserting groove 70 formed on the peripheral wall 61*d* of the bulb inserting hole 61*a* of the socket 61 is sectionally T-shaped and has a narrow-width portion on the inner peripheral surface of a large-width portion 70*a*, the width of which is a larger than the width W1 of the base portion 62*c* of the cathode terminal 62. The narrow-width portion opens in the peripheral wall 61*d*.

Figure 17:
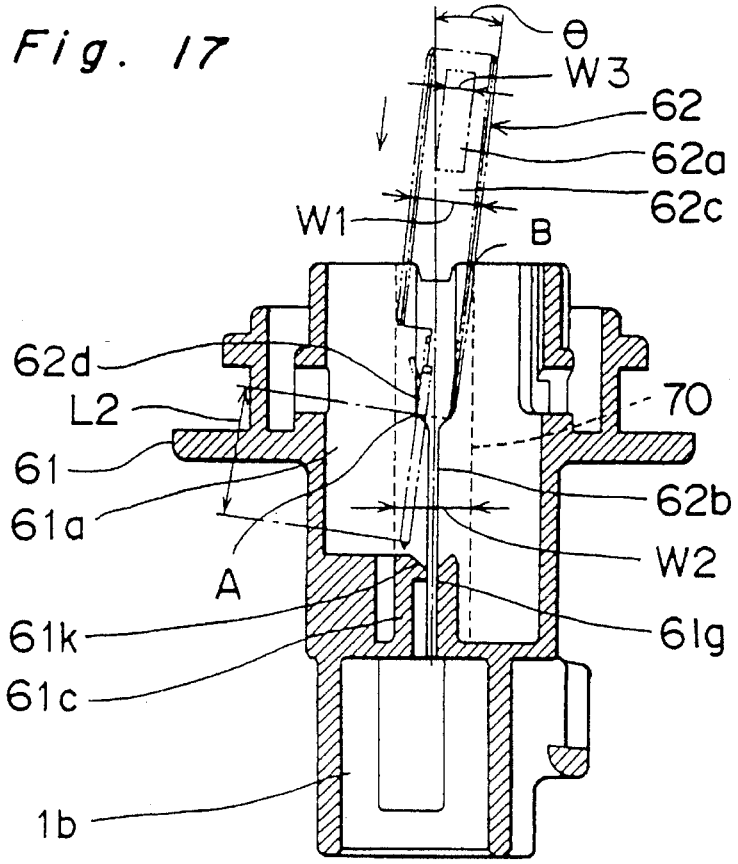
FIG. 17 is an explanatory view showing the state in which the cathode terminal is being inserted into the bulb socket of FIG. 16.

As shown in FIGS. 16 and 17, in the narrow-width portion which opens in the peripheral wall 61*d*, the width W4 of an upper portion 70*b* of the cathode terminal inserting groove 70 is set to be a little larger than the width W3 of the connection strip 62*a* of the cathode terminal 62 so as to form a tapered or V-shaped correcting guide portion 70*c* in the region below the lower end of the upper portion 70*b*. The upper portion 70*b* of the cathode terminal inserting groove 70 extends in the distance from its opening disposed at the upper end of the narrow-width portion to approximately the center between the opening and the partitioning wall 61*c*. The width W5 of the lower portion 70*d* disposed below the guide portion 70*c* is a little larger than the width of the connection strip 62*b* which is inserted into the lower portion 70*d*.

The distance between the guide portion 70*c* and the upper surface of the partitioning wall 61*c* is set to be longer than the length L2 of the connection strip 62*b*.

As shown in FIG. 17, according to the cathode terminal inserting groove 70 of the above-described configuration, when the cathode terminal 62 is diagonally inserted into the cathode terminal inserting groove 70, the shoulder of the base portion 62*d* disposed in the upper portion of the connection strip 62*b* having a greater width than the width W5 of the lower portion 70*d* contacts one of the slopes of the guide portion 70*c* before the lower end of the connection strip 62*b* contacts the upper end surface of the partitioning wall 61*c*. At this time, the base portion 62*c* contacts the upper edge, of the opening of the cathode terminal inserting groove 70, which is opposed to the slope in contact with the base portion 62*d*.

Figure 18:
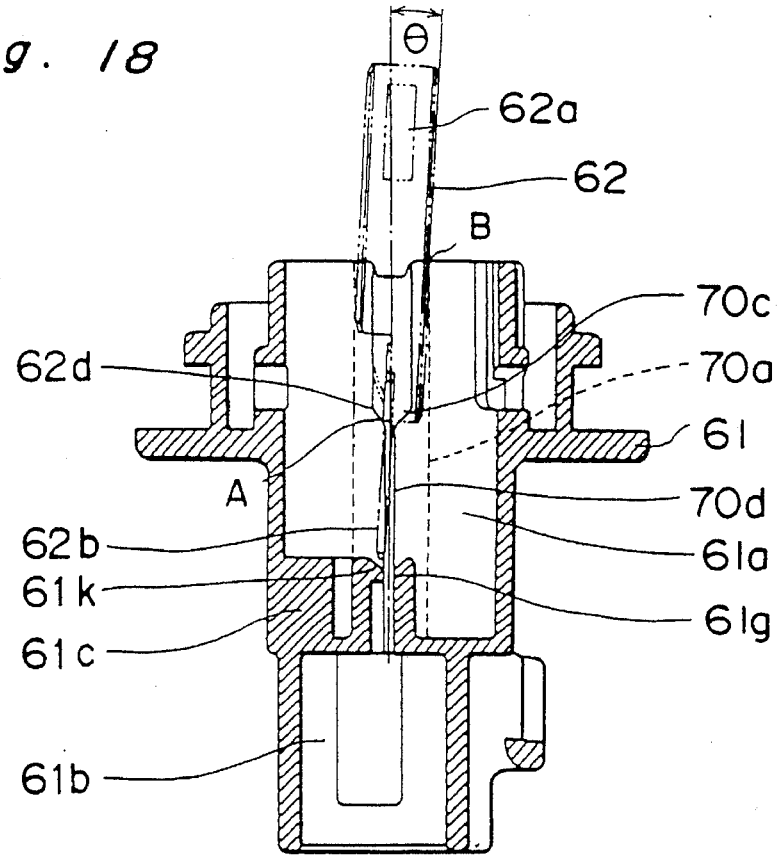
FIG. 18 is an explanatory view showing the state in which the cathode terminal is being inserted into the bulb socket of FIG. 16.

As a result of the contact between the guide portion 70*c* and the connection strip 62*b*, the insertion direction of the cathode terminal 62 becomes vertical while the cathode terminal 62 is moving downwardly along the slope of the guide portion 70*c* as shown in FIG. 18. In addition, the upper end of a terminal inserting opening 61*g* formed on the partitioning wall 61*c* is formed as a slope 61*k* similarly to the guide portion 70*c*. Accordingly, the lower end of the connection strip 62*b* is smoothly guided into the inserting opening 61*g* along the slope 61*k* and as a result, the connection strip 62*b* becomes vertical.

Figure 19:
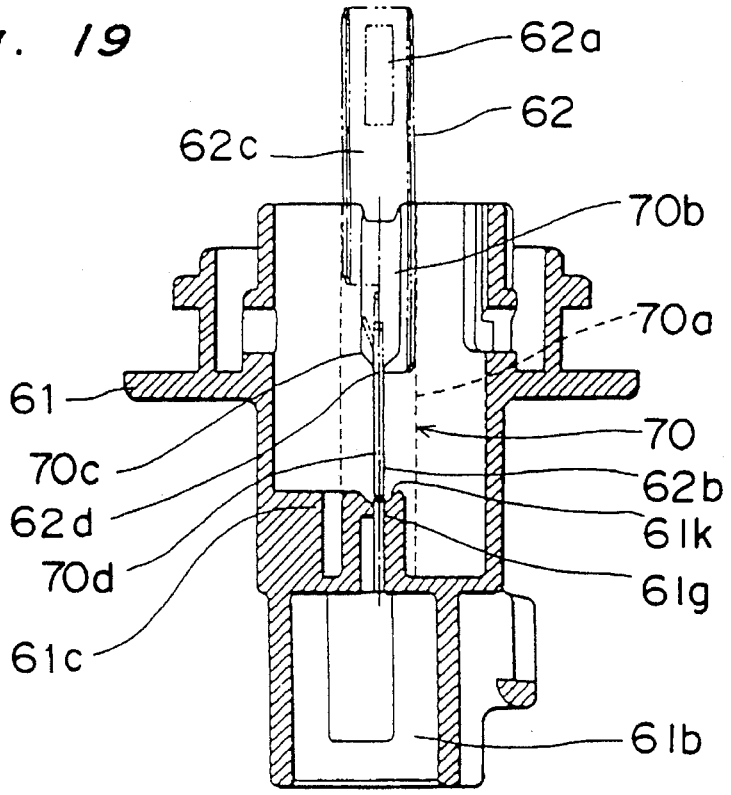
FIG. 19 is an explanatory view showing the state in which the cathode terminal is being inserted into the bulb socket of FIG. 16.
Figure 20:
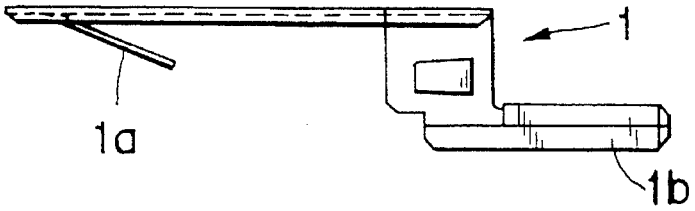
Fig. 20 PRIOR ART
FIG. 20 is a front view showing a conventional cathode terminal.
Figure 21:
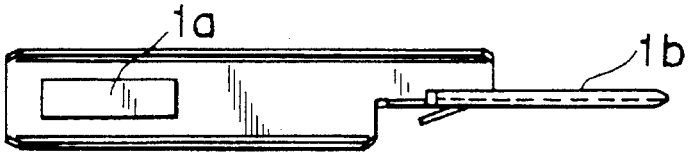
Fig. 21 PRIOR ART
FIG. 21 is plan view of the cathode terminal of FIG. 20.
Figure 22:
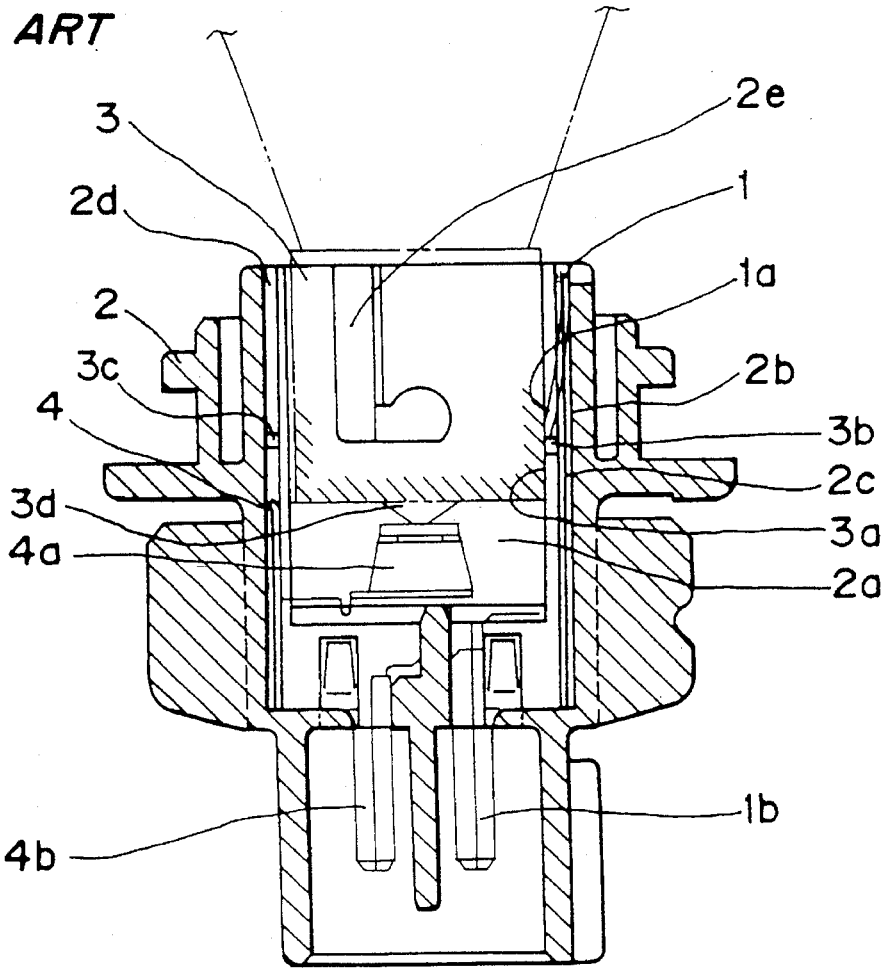
Fig. 22 PRIOR ART
FIG. 22 is a sectional view showing a problem of a case in which the conventional cathode terminal is installed in a bulb socket.
Figure 23:
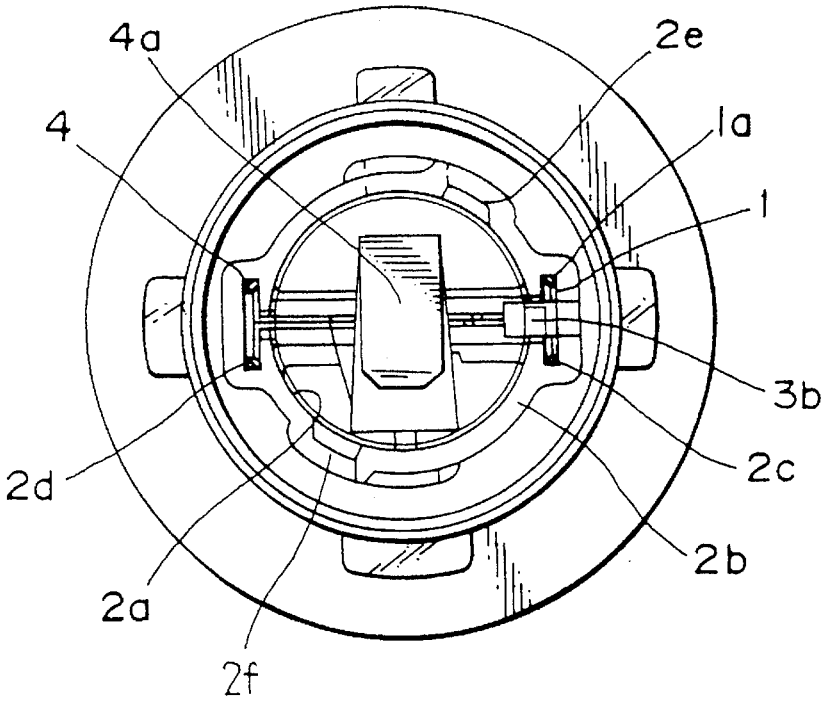
PRIOR ART Fig. 23
FIG. 23 is a plan view of the bulb socket in which a bulb is not mounted.

As shown in FIG. 19, even though the cathode terminal 62 is inserted diagonally into the cathode terminal inserting groove 70, it becomes automatically vertical and the connection strip 62*b* is inserted into the terminal inserting opening 61*g* vertically.

The connection strip 62*a* can be easily projected from the upper portion 70*a* wider than the guide portion 70*c* toward the center of the socket 61 because the guide portion 70*c* is disposed below the connection strip 62*a*.

When the cathode terminal 62 is diagonally inserted into the cathode terminal inserting groove 70 in a direction different from the direction as shown in FIG. 17, the cathode terminal 62 also becomes also vertical in the cathode terminal inserting groove 70 along the other slope of V-shaped guide portion 70*c*. Thus, the cathode terminal 62 can be smoothly inserted into the terminal inserting opening 61*g*.

As apparent from the above description, the tapered V-shaped correcting guide, simple in its configuration, is formed on the cathode terminal inserting groove. Therefore, even though the cathode terminal is inserted diagonally into the cathode terminal inserting groove, it becomes vertical.

Since the connection strip to be connected with the connector can be smoothly inserted into the cathode inserting opening, a favorable operation efficiency can be obtained.

Since the insertion direction of the cathode terminal is corrected from a diagonal direction to a vertical direction, the cathode terminal can be prevented from being deformed or damaged and can be reliably connected with the connector.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A cathode terminal, which is mounted on a bulb socket, said bulb socket including a bulb insertion opening operative to receive a bulb having a bulb mouth piece and bulb pins on a circumferential wall of said bulb mouth piece, and a terminal inserting groove for receiving said cathode terminal, said cathode terminal comprising a bent strip made of conductive material and including one end portion having a connection strip which is bent inwardly and resiliently contacts the bulb mouth piece and an other end portion having a connecting portion connected to a harness connector, said one end portion further including covering means (26), located at the extreme end of said one end portion and which is bent substantially perpendicularly inwardly toward an inside of the bulb socket, for covering the terminal inserting groove when said cathode terminal is fully inserted into the terminal inserting groove thereby to prevent erroneous insertion of at least one of the bulb pins into the terminal inserting groove.

2. The cathode terminal as claimed in claim 1, wherein said inwardly bent covering means (26) is positioned in a vicinity of the bulb insertion opening of the bulb socket.

3. The cathode terminal as claimed in claim 1, wherein said inwardly bent covering means (26) has a width (W1) which is approximately equal to a width (W2) of a narrow-width portion (10*c*-1) of the terminal inserting groove (10*c*).

4. The cathode terminal as claimed in claim 3, wherein said inwardly bent covering means (26) has a length (L1) which is smaller than a dimension (L2) of the narrow-width portion (10*c*-1) of the terminal inserting groove (10*c*).

5. The cathode terminal as claimed in claim 1, wherein said inwardly bent covering means (26) forms a corner portion, and further comprising a bead portion (27) formed in said corner portion.

* * * * *

UNITED STATES PATENT AND TRADEMARK OFFICE

CERTIFICATE OF CORRECTION

PATENT NO. : 5,511,988
DATED : April 30, 1996
INVENTOR(S) : Shinji OGAWA, et al.

It is certified that error appears in the above-indentified patent and that said Letters Patent is hereby corrected as shown below:

On the Title page, please insert the following:

--[*] Notice: The term of this patent shall not extend beyond the expiration date of Pat. No. 5,320,553. --

Signed and Sealed this

First Day of October, 1996

*Attest:*

*Attesting Officer*

BRUCE LEHMAN

*Commissioner of Patents and Trademarks*